US010195765B2

(12) United States Patent
Yoshida et al.

(10) Patent No.: US 10,195,765 B2
(45) Date of Patent: Feb. 5, 2019

(54) GYPSUM BOARD MANUFACTURING METHOD AND MANUFACTURING DEVICE

(71) Applicant: YOSHINO GYPSUM CO., LTD., Tokyo (JP)

(72) Inventors: Tsuyoshi Yoshida, Tokyo (JP); Akira Himeno, Tokyo (JP); Tomohiro Noguchi, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 759 days.

(21) Appl. No.: 14/779,178

(22) PCT Filed: Mar. 24, 2014

(86) PCT No.: PCT/JP2014/057964

§ 371 (c)(1),
(2) Date: Sep. 22, 2015

(87) PCT Pub. No.: WO2014/188772

PCT Pub. Date: Nov. 27, 2014

(65) Prior Publication Data

US 2016/0052167 A1 Feb. 25, 2016

(30) Foreign Application Priority Data

May 22, 2013 (JP) ..... 2013-108116

(51) Int. Cl.
*B28B 19/00* (2006.01)
*B28B 7/00* (2006.01)
*B28B 17/00* (2006.01)

(52) U.S. Cl.
CPC ..... *B28B 19/0015* (2013.01); *B28B 7/0097* (2013.01); *B28B 17/0081* (2013.01); *B28B 19/0092* (2013.01)

(58) Field of Classification Search
CPC ..... B28B 17/0072; B28B 17/0081; B28B 19/0092; B28B 19/0015
(Continued)

(56) References Cited

U.S. PATENT DOCUMENTS 4,626,389 A * 12/1986 Lempfer ..... B28B 5/027 156/39
5,997,779 A * 12/1999 Potter ..... B28B 11/24 156/346

(Continued)

FOREIGN PATENT DOCUMENTS

EP 1116562 7/2001
JP 60-048306 3/1985

(Continued)

OTHER PUBLICATIONS

International Search Report, issued in the corresponding PCT application No. PCT/JP2014/057964, dated Jun. 3, 2014, 3 pages.

(Continued)

*Primary Examiner* — Philip C Tucker
*Assistant Examiner* — John Blades
(74) *Attorney, Agent, or Firm* — Hamre, Schumann, Mueller & Larson, P.C.

(57) ABSTRACT

As a lower forming plate 8, a forming plate having: a lower plate main body 10 constituted from an electrically conductive material; and a lower embedded electrode 12 embedded in the lower plate main body 10, the lower embedded electrode 12 being electrically insulated from the lower plate main body 10 by an insulator 14 and being embedded so as for a portion thereof to be exposed on the surface of the lower plate main body 10 making contact with a lower lining paper sheet 16 is used.

10 Claims, 5 Drawing Sheets

(58) Field of Classification Search
USPC ..... 156/39
See application file for complete search history.

(56) References Cited

U.S. PATENT DOCUMENTS

| | | | | |
|---|---|---|---|---|
| 6,045,730 | A * | 4/2000 | Potter | B28B 11/24 156/346 |
| 6,471,799 | B1 * | 10/2002 | Sasaki | B28B 17/0081 156/273.9 |
| 2007/0028480 | A1 * | 2/2007 | Capron | B65G 43/08 34/217 |
| 2010/0132869 | A1 * | 6/2010 | Okazaki | B28B 1/29 156/39 |

FOREIGN PATENT DOCUMENTS

| | | |
|---|---|---|
| JP | 01-159204 | 6/1989 |
| JP | 2000-071218 | 3/2000 |
| JP | 2003-266414 | 9/2003 |
| JP | 2003-334809 | 11/2003 |

OTHER PUBLICATIONS

Extended European Search Report, issued in the corresponding European Patent Application No. 14800996.2, dated Dec. 23, 2016, 5 pages.

* cited by examiner

[Figure 1]
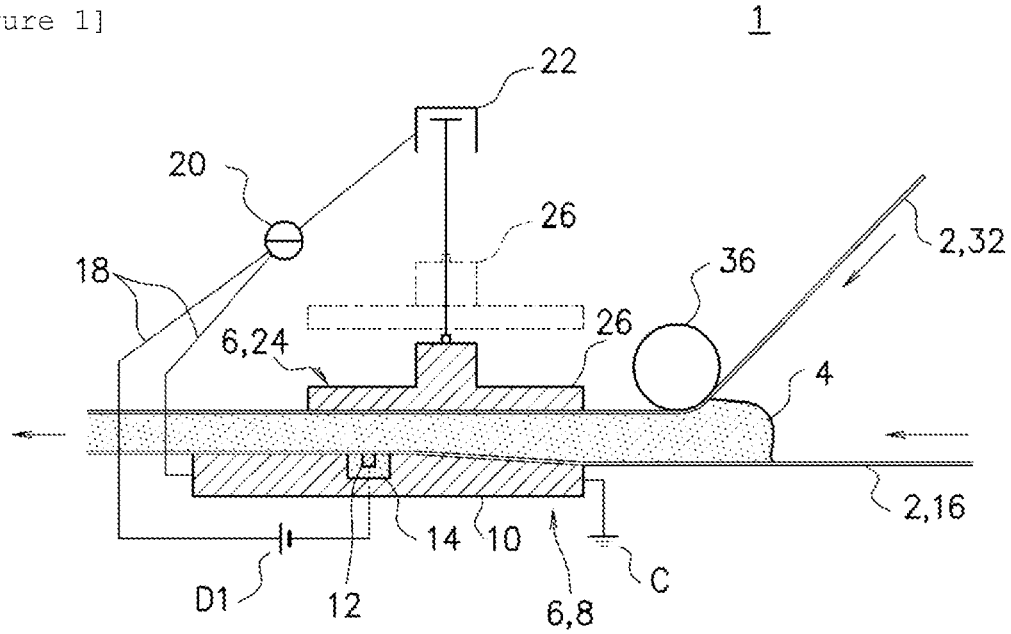
[Figure 2]
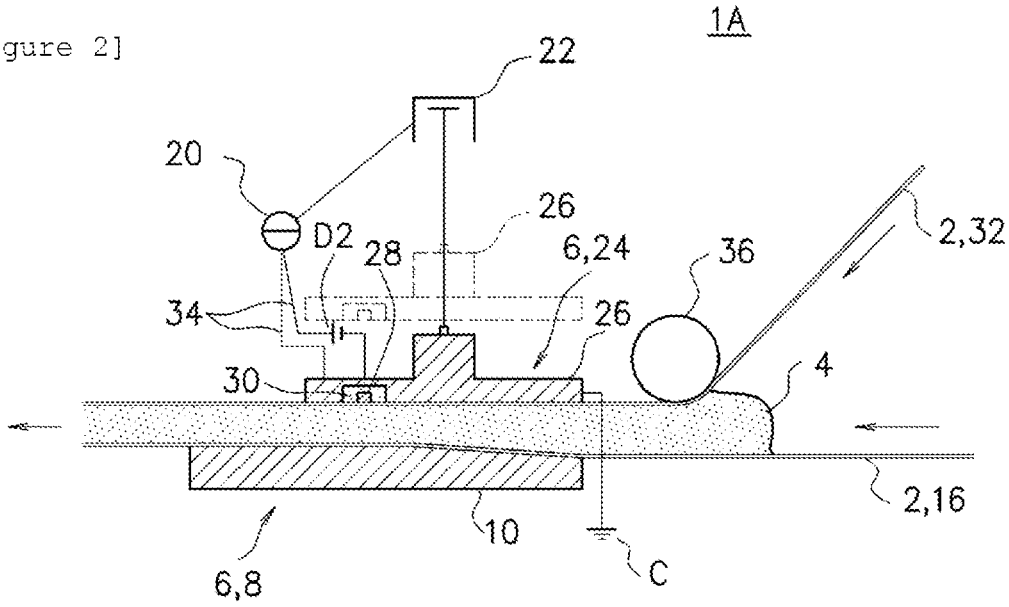

[Figure 3]
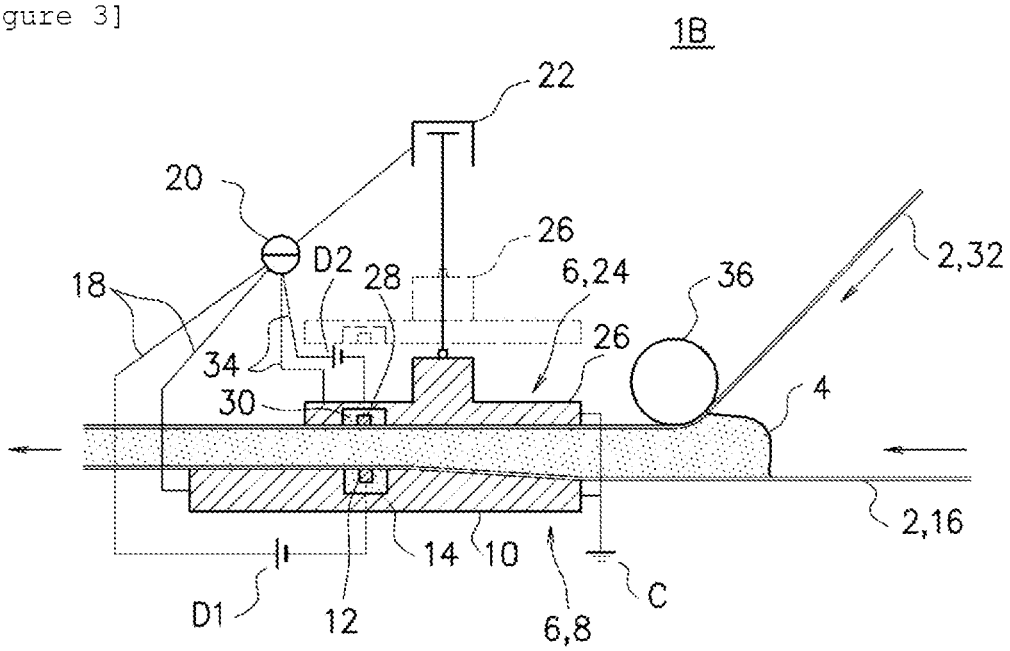
[Figure 4]
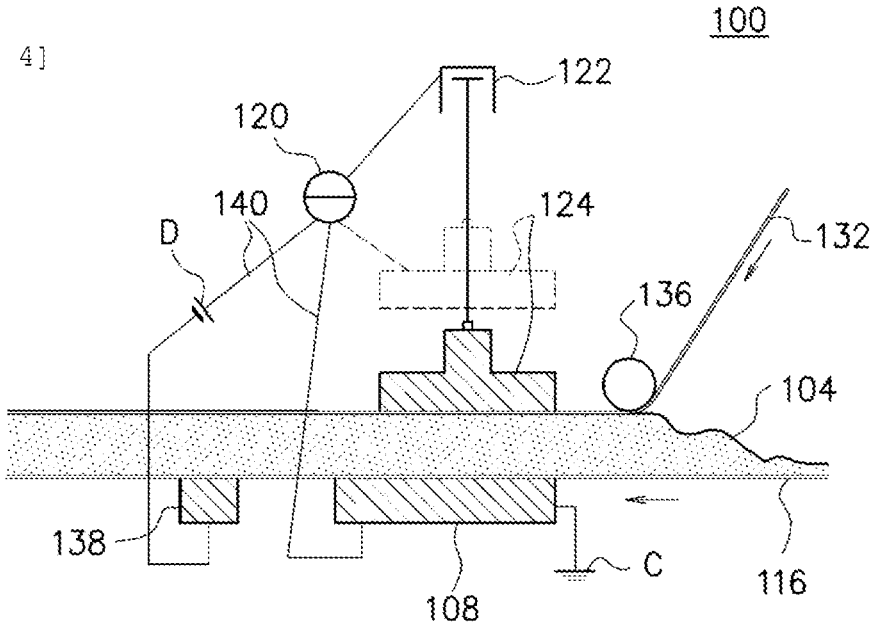
Prior Art

[Figure 5]
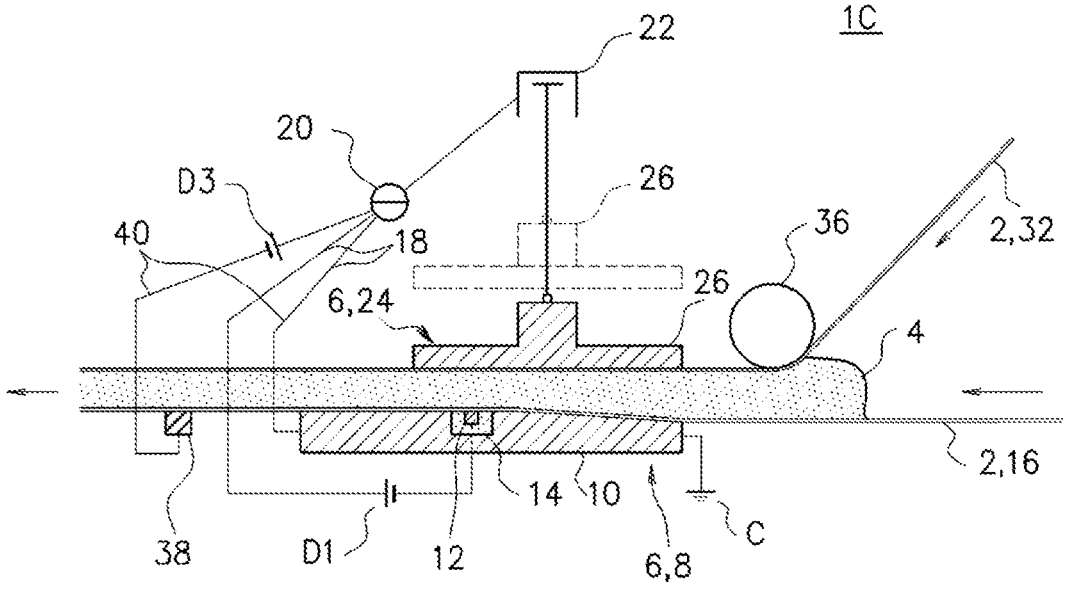
[Figure 6A]
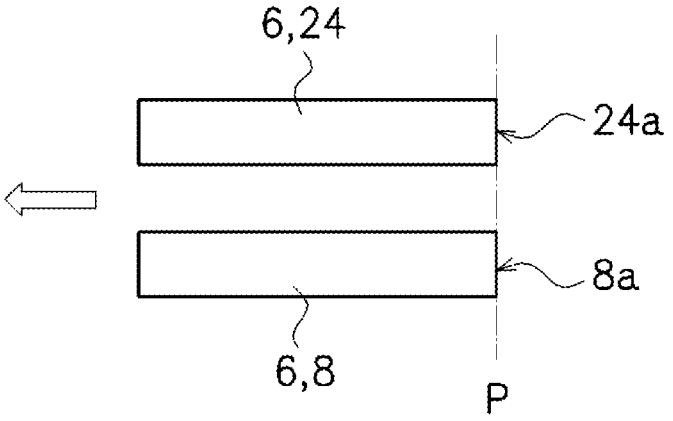

[Figure 6B]
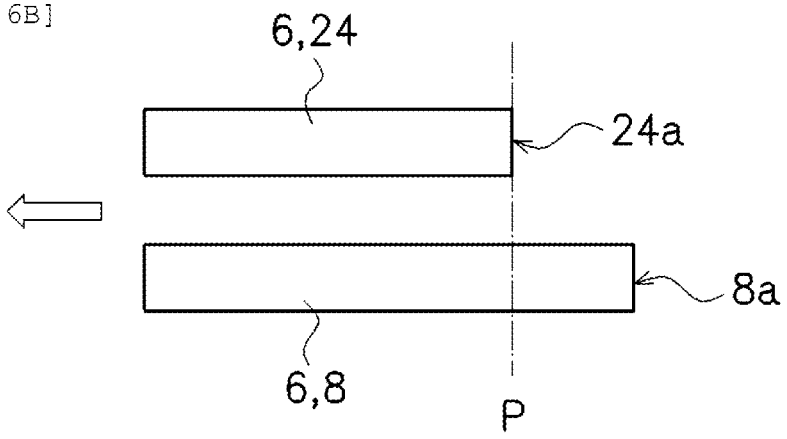
[Figure 6C]
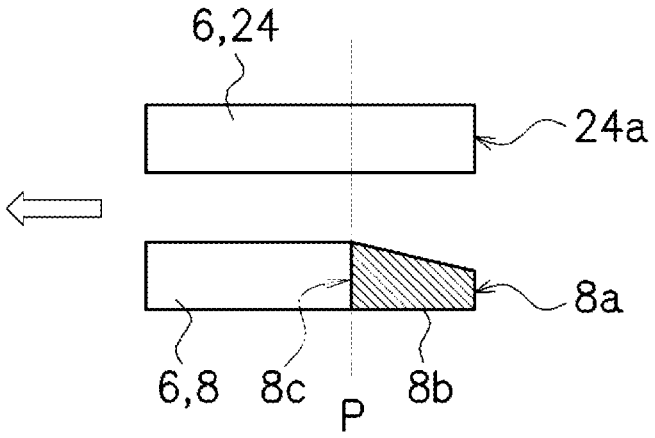
[Figure 6D]
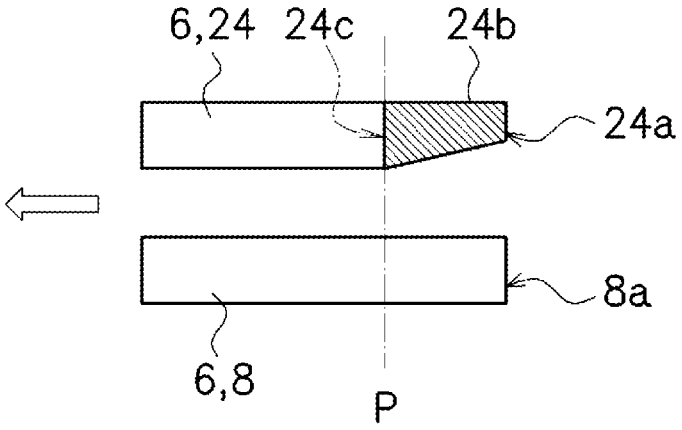

[Figure 6E]
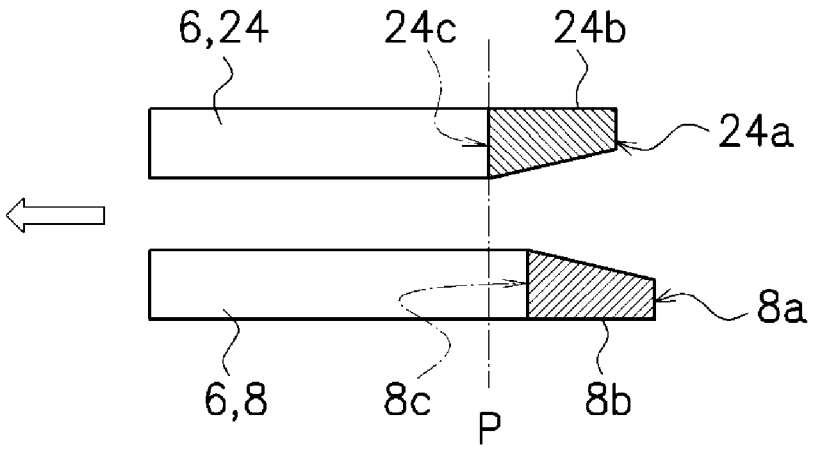

GYPSUM BOARD MANUFACTURING METHOD AND MANUFACTURING DEVICE

TECHNICAL FIELD

The present invention relates to a method and an apparatus for producing a gypsum board.

BACKGROUND ART

A gypsum board is a sheet-like body having a structure in which an upper face, a lower face, and left and right side faces of a gypsum slab are covered by lining paper sheets, and is widely used as building materials such as ceiling materials, wall materials, and flooring materials.

As a method for producing a gypsum board, the following production method for example is known. First of all, a laminated material in which a gypsum slurry is continuously injected into a gap between a pair of lining paper sheets are formed while continuously supplying the pair of lining paper sheets. In forming the laminated material, the lower lining paper sheet is hold upward along a marked line formed in the edge portions of both sides thereof. Thereby, the upper face of the gypsum slurry is covered by the upper lining paper sheet, and the lower side face and left and right side faces of the gypsum slurry are covered by the lower lining paper sheet. The laminated material formed in this way is allowed to pass between a pair of upper and lower forming plates, thereby obtaining a molded body having a thickness depending on a space between plates. A gypsum board is obtained as a final product by drying the molded body.

However, in such a production method, there has been a problem that when, for example, the gypsum slurry is contaminated by foreign bodies (such as a lump of gypsum), the foreign bodies are caught between a pair of upper and lower forming plates and the lining paper sheet is cut by the foreign bodies. The problem is brought about because the foreign bodies larger than the space between a pair of upper and lower forming plates are caught between the pair of upper and lower forming plates when the gypsum slurry containing the foreign bodies enters there, and therefore the progress of the lining paper sheet is inhibited at the portion where the foreign bodies are caught while the progress of the lining paper sheet continues to progress at the other portions. When the production is continued with the situation where the foreign bodies are caught left unchanged, the lining paper sheet continuously supplied is continued to be cut, resulting in continuous production of defective gypsum board products. Moreover, when such a situation is continued, the lining paper sheet is finally torn completely, and therefore not only supply of the lining paper sheet but also production of the gypsum board cannot be continued. In such a case, complicated operation in which the foreign bodies are immediately removed, then the lining paper sheets are supplied again between the pair of upper and lower forming plates, and the gypsum slurry is injected into the gap of the pair of upper and lower lining paper sheets to restart the production has had to be conducted.

In order to solve the problems as described previously, the present applicant has proposed an apparatus for producing a gypsum board constituted so that a space between a pair of upper and lower forming plates is expanded when the cut of the lining paper sheet is detected (Patent Literature 1). The apparatus includes, for example, as shown in an apparatus 100 for producing a gypsum board as illustrated in FIG. 4, a roll 136, an upper side forming plate 124, a lower side forming plate 108, an electrode (lower side external electrode 138) arranged on the downstream side of the lower side forming plate 108 apart from the lower side forming plate 108, an electric current detector 120, and an air cylinder 122. And a circuit 140 is constituted by electrically connecting the lower side external electrode 138 and the lower side forming plate 108, and the electric current detector 120 and a power source D are electrically connected to the circuit 140.

The apparatus 100 for producing a gypsum board makes it possible to detect the cut of the lining paper sheet by making use of the fact that the lining paper sheet is an insulator and the gypsum slurry is a good conductor of electricity. That is to say, in the apparatus 100 for producing a gypsum board, when the lower lining paper sheet 116 that is an insulator is cut, the gypsum slurry that is a good conductor makes contact with the lower side forming plate 108 and the lower side external electrode 138 and an electric current flows in the circuit 140, and therefore the cut of the lower lining paper sheet 116 can be detected by the electric current detector 120. Next, the air cylinder 122 lifts the upper side forming plate 124 depending on a signal from the electric current detector 120, thereby expanding the space between the upper side forming plate 124 and the lower side forming plate 108. Thereby, foreign bodies caught between the upper side forming plate 124 and the lower side forming plate 108 pass between the pair of forming plates. Thereafter, when the position of the upper side forming plate 124 is restored to the original position, production can be restarted. According to the production apparatus, the gypsum board can be produced continuously without stopping production and continuous production of a large amount of detective products can be avoided. Moreover, in addition to the detection of the cut of the lining paper sheet attributable to contamination of foreign bodies, the existence of defects can be detected because the gypsum slurry leaks out also in the case where defects (holes) are originally open in the lining paper sheet which makes an electric current to flow in the circuit 140.

CITATION LIST

Patent Literature

Patent Literature 1: Japanese Patent No. 3315935

SUMMARY OF INVENTION

Technical Problem

However, the cases where the lining paper sheet is torn immediately after the foreign bodies in the gypsum slurry are caught between the forming plates and the production of a gypsum board is stopped have been increasing attributable to the following reasons: (1) the production speed of gypsum boards is becoming higher due to the technological innovation of gypsum board production technology in recent years, and therefore the tension applied on the lining paper sheet is increased; (2) reducing the weight and thickness of the lining paper sheets is facilitated from pressure to reduce costs, and therefore the lining paper sheets are becoming easier to cut; and so on.

Accordingly, a production method has earnestly been desired that makes it possible to continuously produce a gypsum board, the method being applicable to: high speed production of gypsum boards; production in which tension applied on the lining paper sheets is increasing; and production with a lining paper sheet having reduced weight and thickness, without stopping the production.

The present invention has been completed for solving the problems of the conventional technologies, and provides a method and an apparatus for producing a gypsum board making it possible to continuously produce a gypsum board, the method and apparatus being applicable to: high speed production of gypsum boards; production in which tension applied on the lining paper sheets is increasing; and production with a lining paper sheet having reduced weight and thickness, without stopping the production.

Solution to Problem

The present inventors have conducted diligent studies on the above-described problems to find that the problems of the conventional technologies can be solved by embedding inside the forming plate an electrode for detecting paper cut which have conventionally been arranged on the downstream side of the end of the forming plate, and have completed the present invention.

That is to say, according to the present invention, there is provided a method for producing a gypsum board, the method comprising a step of continuously injecting a gypsum slurry into a gap between a pair of upper and lower lining paper sheets while continuously supplying the pair of upper and lower lining paper sheets to form a laminated material and allowing the laminated material to pass between a pair of upper and lower forming plates to obtain a molded body having a thickness depending on a space between the plates, wherein a forming plate comprising: a plate main body constituted from an electrically conductive material; and an embedded electrode embedded in the plate main body, the embedded electrode being electrically insulated from the plate main body by an insulator and being embedded so as for a portion thereof to be exposed on a surface of the plate main body making contact with the lining paper sheet is used as at least one of the pair of upper and lower forming plates, a circuit is constituted by electrically connecting the plate main body and the embedded electrode embedded in the plate main body, and voltage is applied to the circuit, and when the lining paper sheet is cut to bring the plate main body and the embedded electrode into contact with the gypsum slurry and an electric current flows in the circuit, the space between the pair of upper and lower forming plates is expanded to remove a cause of conduction, and thereafter the space between the pair of upper and lower forming plates is restored to the original space.

In the production method of the present invention, it is preferable that the embedded electrode is embedded at a portion on the downstream side of the following starting position of forming in the plate main body.

[Starting Position of Forming]

A position on the most downstream side of the following (1) and the following (2):

(1) a position of an upstream end of either one of the pair of upper and lower forming plates; and (2) a position of a downstream end of a taper portion in an embodiment wherein the taper portion whose plate thickness at a position in the taper portion becomes thinner as the position approaches upstream ends of the forming plates is formed in at least one of the pair of upper and lower forming plates, and a space between the pair of the forming plates at a position in the taper portion becomes larger, due to the taper portion, as the position approaches the upstream ends of the forming plates.

Moreover, in the production method of the present invention, it is preferable that: the embedded electrode is embedded, in the plate main body, at a portion within a range from the starting position of forming to a position on a downstream side of the starting position of forming by 50 mm; at least one material selected from the group consisting of phenol resin laminated plates with a cloth base material, phenol resin laminated plates with a paper base material, epoxy resin-impregnated glass fiber cloth, and epoxy resin-impregnated paper is used as the insulator; and at least one material selected from the group consisting of iron materials, stainless steel materials, and aluminum materials, or a material obtained by applying hard chromium plating thereon is used as the electrically conductive material.

Furthermore, according to the present invention, there is provided an apparatus for producing a gypsum board comprising a pair of upper and lower forming plates for forming a laminated material obtained by injecting a gypsum slurry into a gap between a pair of upper and lower lining paper sheets, the laminated material having a thickness depending on a space between the plates, wherein at least one of the pair of upper and lower forming plates comprises: a plate main body constituted from an electrically conductive material; and an embedded electrode embedded in the plate main body, the embedded electrode being electrically insulated from the plate main body by an insulator and being embedded so as for a portion thereof to be exposed on a surface of the plate main body making contact with the lining paper sheet, a circuit is constituted by electrically connecting the plate main body and the embedded electrode embedded in the plate main body, and the apparatus further comprises: an electric current detector electrically connected to the circuit; and an actuator moving at least one of the forming plates up and down in response to an electric signal from the electric current detector.

In the production apparatus of the present invention, it is preferable that the embedded electrode is embedded at a portion on a downstream side of the following starting position of forming in the plate main body.

[Starting Position of Forming]

A position on the most downstream side of the following (1) and the following (2):

(1) a position of an upstream end of either one of the pair of upper and lower forming plates; and (2) a position of a downstream end of a taper portion in an embodiment wherein the taper portion whose plate thickness at a position in the taper portion becomes thinner as the position approaches upstream ends of the forming plates is formed in at least one of the pair of upper and lower forming plates, and a space between the pair of the forming plates at a position in the taper portion becomes larger, due to the taper portion, as the position approaches the upstream ends of the forming plates.

Further, in the production apparatus of the present invention, it is preferable that: the embedded electrode is embedded, in the plate main body, at a portion within a range from the starting position of forming to a position on a downstream side of the starting position of forming by 50 mm; the insulator is constituted from at least one material selected from the group consisting of phenol resin laminated plates with a cloth base material, phenol resin laminated plates with a paper base material, epoxy resin-impregnated glass fiber cloth, and epoxy resin-impregnated paper; and the electrically conductive material is at least one material selected from the group consisting of iron materials, stainless steel materials, and aluminum materials, or a material obtained by applying hard chromium plating thereon.

Advantageous Effects of Invention

According to the method or apparatus for producing a gypsum board, it becomes possible to continuously produce a gypsum board by the method and apparatus being applicable to high speed production of gypsum boards, production in which tension applied on the lining paper sheets is increasing, and production with a lining paper sheet having reduced weight and thickness, without stopping the production.

BRIEF DESCRIPTION OF DRAWING

FIG. 1 is a schematic side view schematically illustrating an embodiment of an apparatus for producing a gypsum board of the present invention.

FIG. 2 is a schematic side view schematically illustrating another embodiment of an apparatus for producing a gypsum board of the present invention.

FIG. 3 is a schematic side view schematically illustrating yet another embodiment of an apparatus for producing a gypsum board of the present invention.

FIG. 4 is a schematic side view schematically illustrating an example of a conventional apparatus for producing a gypsum board.

FIG. 5 is a schematic side view schematically illustrating a still another embodiment of an apparatus for producing a gypsum board of the present invention FIG. 6A is a conceptual diagram schematically explaining a starting position of forming in an apparatus for producing a gypsum board of the present invention.

FIG. 6B is a conceptual diagram schematically explaining a starting position of forming in an apparatus for producing a gypsum board of the present invention.

FIG. 6C is a conceptual diagram schematically explaining a starting position of forming in an apparatus for producing a gypsum board of the present invention.

FIG. 6D is a conceptual diagram schematically explaining a starting position of forming in an apparatus for producing a gypsum board of the present invention.

FIG. 6E is a conceptual diagram schematically explaining a starting position of forming in an apparatus for producing a gypsum board of the present invention.

DESCRIPTION OF EMBODIMENTS

Hereinafter, the present invention will be explained in detail. However, the present invention is not limited to the following embodiments and includes all the objects containing matters used to specify the present invention.

[1] Method for Producing Gypsum Board:

The method for producing a gypsum board relates to a method for producing a gypsum board, the method comprising a step of continuously injecting a gypsum slurry into a gap between a pair of upper and lower lining paper sheets while continuously supplying the pair of upper and lower lining paper sheets to form a laminated material and allowing the laminated material to pass between a pair of upper and lower forming plates to obtain a molded body having a thickness depending on a space between the plates.

For example, any of a production apparatus 1 as illustrated in FIG. 1, a production apparatus 1A as illustrated in FIG. 2, a production apparatus 1B as illustrated in FIG. 3, and a production apparatus 1C as illustrated in FIG. 5 is a production apparatus capable of conducting the production method of the present invention, and with the production apparatuses, the step of continuously injecting the gypsum slurry 4 into the gap between a pair of upper and lower lining paper sheets 2 while continuously supplying the pair of upper and lower lining paper sheets 2 to form a laminated material and allowing the laminated material to pass between the pair of upper and lower forming plates 6 to obtain a molded body having a thickness depending on the space between the plates.

The gypsum slurry is a slurry containing calcined gypsum (β-type hemihydrate gypsum and α-type hemihydrate gypsum) and water as main components. In the present invention, the gypsum slurry includes a slurry using type III anhydrous gypsum in place of part or the whole of the calcined gypsum. The gypsum slurry may contain an additive such as an adhesion improver, a curing accelerator, or an admixture ingredient in addition to calcined gypsum and water.

The lining paper sheet is a lining paper sheet for producing a gypsum board. In the present invention, the lining paper sheet includes a glass fiber mat for producing a gypsum board. A sizing agent is mixed in the lining paper sheet for the purpose of suppressing water absorption and securing insulation properties during forming. Accordingly, water in the gypsum slurry does not penetrate into a surface layer of the lining paper sheet (a layer on the side not making contact with the gypsum slurry) immediately after the lining paper sheet makes contact with the gypsum slurry, and the lining paper sheet functions as an insulator. The thickness of the lining paper sheet is not particularly limited, however lining paper sheets having a thickness of 0.2 to 1.0 mm are usually used.

The production method of the present invention can suitably be used when gypsum boards are produced at a high speed. Specifically, the production method of the present invention can suitably be used when gypsum boards are produced at a production speed of 60 m/min or more.

[1-1] Forming Plates:

In the production method of the present invention, a forming plate having: a plate main body constituted from an electrically conductive material; and an embedded electrode embedded in the plate main body, the embedded electrode being electrically insulated from the plate main body by an insulator and being embedded so as for a portion thereof to be exposed on a surface of the plate main body making contact with the lining paper sheet is used as at least one of the pair of upper and lower forming plates. By embedding the electrode for detecting the cut of the lining paper sheet in the plate main body, it becomes possible to detect the cut of the lining paper sheet earlier than in the case where the electrode is arranged on the downstream side of the end of the plate main body.

For example, when it is necessary to detect the cut of the lower lining paper sheet, a forming plate having: the lower plate main body 10 constituted from an electrically conductive material; and the lower embedded electrode 12 embedded in the lower plate main body 10, the lower embedded electrode 12 being electrically insulated from the lower plate main body 10 by the insulator 14 and being embedded so as for a portion thereof to be exposed on the surface of the lower plate main body 10 making contact with the lower lining paper sheet 16 is used as the lower forming plate 8, as shown in the production apparatus 1 as illustrated in FIG. 1.

Based on the similar idea, when it is necessary to detect the cut of the upper lining paper sheet, a forming plate having: the upper plate main body 26 constituted from an electrically conductive material; and the upper embedded electrode 28 embedded in the upper plate main body 26, the upper embedded electrode 28 being electrically insulated from the upper plate main body 26 by the insulator 30 and being embedded so as for a portion thereof to be exposed on the surface of the upper plate main body 26 making contact with the upper lining paper sheet 32 may be used as the upper forming plate 24, as shown in the production apparatus 1A as illustrated in FIG. 2.

Further, when it is necessary to detect the cut of both the lower lining paper sheet and the upper lining paper sheet, the lower forming plate 8 as illustrated in FIG. 1 and the upper forming plate 24 as illustrated in FIG. 2 can be used together. That is to say, a forming plate having the lower embedded electrode 12 and the forming plate having an upper embedded electrode 28 are used as the lower forming plate 8 and the upper forming plate 24 respectively as illustrated in the production apparatus 1B in FIG. 3.

Furthermore, an external electrode for detecting the cut of paper can be installed outside of the forming plate in addition to the embedded electrode for the purpose of backing up the embedded electrode. In the production apparatus 1C as illustrated in FIG. 5 for example, a forming plate having the embedded electrode 12 is used as the lower forming plate 8, and a lower external electrode 38 for detecting the cut of paper is further installed outside of the lower forming plate 8. The lower external electrode 38 is arranged on the downstream side of the lower forming plate 8 apart from the lower forming plate 8. Moreover, the lower external electrode 38 is arranged so as to make contact with the lower lining paper sheet 16. In such constitution, a circuit 40 that includes the lower external electrode 38, the lower plate main body 10, and a power source D3 backs up a circuit 18, thereby making it possible to detect the cut of paper in case the cut of paper cannot be detected by the circuit 18 including the embedded electrode 12, the lower plate main body 10, and the power source D1.

In addition, the lower external electrode 38 as illustrated in FIG. 5 can also be installed in the production apparatus 1A as illustrated in FIG. 2 or the production apparatus 1B as illustrated in FIG. 3. In such cases, the effect of backing up a circuit including an embedded electrode (lower embedded electrode 12 or upper embedded electrode 28) such as the circuit 34 illustrated in FIG. 2, and the circuits 18 and 34 illustrated in FIG. 3 can also be obtained by the circuit 40 including the lower external electrode 38, the lower plate main body 10, and the power source D3.

An upper external electrode (not illustrated in figures) can also be used as the external electrode for backup. The upper external electrode is an electrode that is arranged on the downstream side of the upper forming plate apart from the upper forming plate, and is arranged so as to make contact with the upper lining paper sheet. The circuit for backup that consists of the upper external electrode, the upper plate main body, and the power source can detect the cut of paper in the same manner as in the circuit 40 including the lower external electrode 38 as illustrated in FIG. 5, thereby making it possible to obtain the effect of backing up the circuit including the embedded electrode. Accordingly, the circuit including the upper external electrode can be used in place of or together with the circuit 40 including the lower external electrode 38.

In the method for producing a gypsum board of the present invention, the constitution of the lower forming plate and upper forming plate is particularly important.

Specifically, the position where the upper embedded electrode or lower embedded electrode is arranged, the material quality of the insulator, the material quality of the electrically conductive material that constitutes the upper plate main body or lower plate main body, and so on become important. These will be explained specifically in the section of Apparatus for Producing Gypsum Board.

[1-2] Circuit:

In the production method of the present invention, the circuit is constituted by electrically connecting the plate main body and the embedded electrode embedded in the plate main body, and voltage is applied to the circuit. Thereby, it becomes possible to detect the cut of the lining paper sheet when the plate main body and the embedded electrode make contact with the gypsum slurry and an electric current flows.

For example, when it is necessary to detect the cut of the lower lining paper sheet, the circuit 18 may be constituted by electrically connecting the lower embedded electrode 12 and the lower plate main body 10 to apply voltage to the circuit 18 as illustrated in FIG. 1. On the other hand, when it is necessary to detect the cut of the upper lining paper sheet, the circuit 34 may be constituted by electrically connecting the upper embedded electrode 28 and the upper plate main body 26 to apply voltage to the circuit 34 as illustrated in FIG. 2. Further, when it is necessary to detect the cut of both the lower lining paper sheet and the upper lining paper sheet, the circuit 18 may be constituted by electrically connecting the lower embedded electrode 12 and the lower plate main body 10 and the circuit 34 may also be constituted by electrically connecting the upper embedded electrode 28 and the upper plate main body 26 to apply voltage to both the circuit 18 and the circuit 34 as illustrated in FIG. 3.

The voltage applied to the circuit may be an alternating current or a direct current, and it is preferable that the voltage is a low voltage that is not dangerous to an operator when the operator makes contact with the circuit. It is preferable that the voltage is set to, for example, about AC 8V. Further, it is preferable that the lower plate main body 10 and/or the upper plate main body 26 are connected to a ground C as illustrated in FIG. 1 to FIG. 3. Even a small electric potential difference can be detected by connecting these plate main bodies to the ground.

[1-3] Expansion of Space Between Plates:

In the production method of the present invention, the space between a pair of forming plates is expanded when an electric current flows in the circuit (namely, the cut of the lining paper sheet or the like is detected). Thereby, the foreign bodies that have been caught between the pair of upper and lower forming plates easily pass between the forming plates. Accordingly, the lining paper sheet does not continue to be cut due to the foreign bodies, and it never occurs that the lining paper sheet is completely torn and the production is stopped.

In the case where the production apparatus 1 as illustrated in FIG. 1 is used for example, the space between a pair of the forming plates 6 can be expanded when an electric current flows in the circuit 18 (namely, when the cut of the lower lining paper sheet 16, or the like is detected). On the other hand, in the case where the production apparatus 1A as illustrated in FIG. 2 is used, the space between a pair of the forming plates 6 can be expanded when an electric current flows in the circuit 34 (namely, when the cut of the upper lining paper sheet 32, or the like is detected). Further, in the case where the production apparatus 1B as illustrated in FIG. 3 is used, the space between a pair of forming plates 6 can be expanded when an electric current flows in either the circuit 18 or the circuit 34 (namely, when the cut of either the lower lining paper sheet 16 or the upper lining paper sheet 32 is detected).

Examples of the method for expanding the space between forming plates include: (i) a method in which the upper forming plate is lifted while maintaining a state where the lower forming plate is fixed; (ii) a method in which the lower forming plate is brought down while maintaining a state where the upper forming plate is fixed; and (iii) a method in which the upper forming plate is lifted and the lower forming plate is brought down, and so on. The method (i) in which the upper forming plate 24 is lifted while maintaining a state where the lower forming plate 8 is fixed is adopted in any of the production apparatus 1 as illustrated in FIG. 1, the production apparatus 1A as illustrated in FIG. 2, and the production apparatus 1B as illustrated in FIG. 3. That is to say, the upper forming plate 24 is lifted to a position shown by broken lines in FIG. 1 to FIG. 3. Such method is more preferable than the method (ii) and the method (iii) in terms of easiness of flow of the lower lining paper sheet when the space between the forming plates 6 is expanded. However, the method (ii) or the method (iii) may be adopted for the purpose of making the cleaning of an apparatus easy, or other purposes.

The space between the forming plates may be expanded to such an extent that the foreign bodies pass between a pair of forming plates. The specific space is not particularly limited, however it is preferable to expand the space by 2 to 4 cm wider than the original space from the reason that the time for expanding the space is made short to allow the foreign bodies to pass, and it is further preferably to expand the space by 2 cm wider. Moreover, it is more preferable that the speed of expanding the space between the forming plates is faster because the cut of the lining paper sheet is reduced more.

The means for expanding and restoring the space between the forming plates is not particularly limited. For example, an actuator can be used that moves up and down at least one of a pair of upper and lower forming plates in response to an electric signal when an electric current is detected. The actuator will be explained specifically in the section of Apparatus for Producing Gypsum Board.

[1-4] Restoration of Space Between Plates:

In the production method of the present invention, the space between a pair of the forming plates is restored to the original space after the cause of conduction is removed. The expression "after the cause of conduction is removed" means "after the foreign bodies that arise the cause of conduction (namely, the cut of the lining paper sheet, or the like) pass between the forming plates". The situation where the foreign bodies are caught between the forming plates again and the lining paper sheet is cut can be prevented by restoring the space between the forming plates to the original space after the foreign bodies pass between the forming plates. And, the production of the gypsum board (the step of obtaining a molded body depending on the space between the forming plates) is restarted. When such a method is adopted, it never occurs that the lining paper sheet is completely torn and the production is stopped. That is to say, it is not necessary to conduct complicated operation in which the foreign bodies are removed, then the lining paper sheet is supplied again between a pair of upper and lower forming plates, and the gypsum slurry is injected into the gap of the pair of upper and lower lining paper sheets to restart the production.

Whether the cause of conduction is removed or not is evaluated by both the fact that the electric current has stopped flowing and the fact that the foreign bodies have passed between the forming plates. The fact that the electric current has stopped flowing can be detected by the electric current detector or the like which is electrically connected to the circuit. Examples of the method for restoring the space between the plates to the original space after the foreign bodies pass between the plates include a method in which the passing time required for the foreign objects to pass between the plates is determined from the feeding speed of the laminated body consisting of lining paper sheets and a gypsum slurry and the length of the forming plates, and the space between the plates is restored to the original space after the elapse of the passing time. Further, the examples also include a method in which the number of revolutions of the roll of a belt conveyor for feeding the laminated body is counted by a measuring roll, then the number of revolutions of the roll that corresponds to the time required for the foreign bodies to pass between the plates is determined from the relation between the number of revolutions of the roll and the feeding distance of the belt conveyor, and the space between plates is restored to the original space after the number of revolutions of the roll thus determined is counted.

The speed of restoring the space between the forming plates is not specifically limited. However, it is preferable to set the speed so that there is not a risk that the upper or lower lining paper sheet is not cut or the gypsum slurry on the lower lining paper sheet overflows and leaks outside.

[2] Apparatus for Producing Gypsum Board:

The method for producing a gypsum board of the present invention can be conducted, for example, with the apparatus for producing a gypsum board of the present invention explained below. The apparatus for producing a gypsum board of the present invention includes: a pair of upper and lower forming plates; an electric current detector; and an actuator as constituent members. Hereinafter, explanation will be made for each constituent member separately.

[2-1] Forming Plates:

The production apparatus of the present invention includes a pair of upper and lower forming plates for forming a laminated material obtained by injecting a gypsum slurry into a gap between a pair of upper and lower lining paper sheets so that the laminated material has a thickness depending on the space between the plates. For example, any of the production apparatus 1 as illustrated in FIG. 1, the production apparatus 1A as illustrated in FIG. 2, and the production apparatus 1B as illustrated in FIG. 3 includes a pair of upper and lower forming plates 6 (lower forming plate 8 and upper forming plate 24) for forming a laminated material obtained by injecting the gypsum slurry 4 into the gap between a pair of upper and lower lining paper sheets 2 so that the laminated material has a thickness depending on the space between the plates.

At least one of a pair of upper and lower forming plates in the production apparatus of the present invention has: a plate main body constituted from an electrically conductive material; and an embedded electrode embedded in the plate main body. With the embedded electrode, it becomes possible to detect the cut of the lining paper sheet early.

For example, in the production apparatus 1 as illustrated in FIG. 1, the lower forming plate 8 has: the lower plate main body 10; and the lower embedded electrode 12 embedded in the lower plate main body 10 for the purpose of detecting the cut of the lower lining paper sheet 16. On the other hand, in the production apparatus 1A as illustrated in FIG. 2, the upper forming plate 24 has: the upper plate main body 26; and the upper embedded electrode 28 embedded in the upper plate main body 26 for the purpose of detecting the cut of the upper lining paper sheet 32. In order to detect the cut of both the lower lining paper sheet and the upper lining paper sheet, a structure may be made in which the lower forming plate 8 has: the lower plate main body 10; and the lower embedded electrode 12 embedded in in the lower plate main body 10 and the upper forming plate 24 has: the upper plate main body 26; and the upper embedded electrode 28 embedded in the upper plate main body 26, as shown in the production apparatus 1B as illustrated in FIG. 3.

The plate main body is a member that constitutes a circuit by being electrically connected to the embedded electrode, and therefore it is necessary that the plate main body be constituted from an electrically conductive material. The kind of the electrically conductive material is not particularly limited. However, since the plate main body is an important member that determines the thickness of a molded body, it is necessary to avoid a change in shape attributable to wear as much as possible. Accordingly, it is preferable that the electrically conductive material that constitutes the plate main body is at least one material selected from the group consisting of iron materials, stainless steel materials, and aluminum materials, or a material obtained by applying hard chromium plating thereon. These materials are preferable in that these materials have a high rigidity and excellent wear resistance and size accuracy in addition to electric conductivity.

It is preferable that a material that constitutes the embedded electrode is also at least one material selected from the group consisting of iron materials, stainless steel materials, and aluminum materials, or a material obtained by applying hard chromium plating thereon from the similar reason to that in the plate main body. The shape of the embedded electrode is not particularly limited and may be used as long as the shape has a width to cover the entire width of a gypsum board to be produced. The embedded electrodes having various kinds of shapes such as, for example, round rod-like, square rod-like, and sheet-like shapes can be used.

The embedded electrode is electrically insulated by an insulator from the plate main body in which the embedded electrode is embedded. Thereby, it is possible to prevent a short circuit between the embedded electrode and the plain main body, and it is also possible to surely detect an electric current that flows between the embedded electrode and the plate main body.

For example, in the production apparatus as illustrated in FIG. 1, the lower embedded electrode 12 and the lower plate main body 10 are electrically insulated by the insulator 14. On the other hand, in the production apparatus 1A as illustrated in FIG. 2, the upper embedded electrode 28 and the upper plate main body 26 are electrically insulated by the insulator 30. Further, in the production apparatus 1B as illustrated in FIG. 3, the lower embedded electrode 12 and the lower plate main body 10 are insulated by the insulator 14 and the upper embedded electrode 28 and the upper plate main body 26 are also insulated by the insulator 30.

In the production apparatus of the present invention, not only the embedded electrode but also the insulator is embedded in the plate main body. Since the plate main body is an important member that determines the thickness of a molded body, it is necessary to avoid a change in shape attributable to wear also in the insulator that forms part of the plate main body as much as possible. Moreover, it is not preferable that the exchanging work of members becomes complicated as a result that the wear resistance between the insulator and the plate main body or the like is different to bring about, for example, a different exchange period for each member. Accordingly, a favorable wear resistance in addition to the insulation performance is required for the insulator. Moreover, since the insulator is a member that is embedded in the plate main body, it is preferable, for the purpose of preventing voids or level difference between the insulator and the plate main body or embedded electrode from occurring, that: (1) the insulator is constituted from a material which has a good processability and which can be processed with a high size accuracy; and (2) the insulator is constituted from a material with which the void or level difference is hard to occur due to a change in size over time.

Conventionally, since it has been difficult to design an insulating material that satisfies the above-described requirements, it has been common general technical knowledge that a molded plate is constituted from a single material, and an idea of embedding an detection electrode inside the molded plate has not existed. For this reason, it is considered that a lower external electrode 138 for detecting the cut of paper has been arranged on a further downstream side of the downstream end of the forming plate (lower forming plate 108) as shown in the production apparatus 100 as illustrated in FIG. 4. In order to solve the above-described problem of the insulating material, it is preferable that the insulator is constituted from at least one material selected from the group consisting of phenol resin laminated plates with a cloth base material (also referred to as "cloth-containing bakelite"), phenol resin laminated plates with a paper base material (also referred to as "paper-containing bakelite"), epoxy resin-impregnated glass fiber cloth (also referred to as "glass-epoxy resins"), and epoxy resin-impregnated paper (also referred to as "paper-epoxy resins"). These materials can suitably be used because of favorable wear resistance, processability, and size accuracy in addition to insulation performance. It is particularly preferable to use the phenol resin laminated plate with a cloth base material that is excellent in wear resistance, processability, and size accuracy among the above-described materials.

In the production apparatus of the present invention, the embedded electrode is embedded so as for a portion thereof to be exposed on the surface of the plate main body making contact with the lining paper sheet. In this case, it is preferable that the embedded electrode is arranged so that there is no level difference between the surface of the plate main body making contact with the lining paper sheet and the surface of the embedded electrode, and is arranged so that there is no gap between the embedded electrode and the insulator that will be mentioned later.

For example, in the production apparatus 1 as illustrated in FIG. 1, the rod-like lower embedded electrode 12 is filled in the groove portion of the insulator 14 having an approximately U-shaped section, and is embedded so as for a portion thereof (upper face) to be exposed on the surface of the lower plate main body 10. On the other hand, in the production apparatus 1A as illustrated in FIG. 2, the rod-like upper embedded electrode 28 is filled in the groove portion of the insulator 30 having an approximately U-shaped section, and is embedded so as for a portion thereof (bottom face) to be exposed on the surface of the upper plate main body 26. Further, in the production apparatus 1B as illustrated in FIG. 3, the rod-like lower embedded electrode 12 is filled in the groove portion of the insulator 14 having an approximately U-shaped section, and is embedded so as for a portion thereof (upper face) to be exposed on the surface of the lower plate main body 10. Furthermore, the rod-like upper embedded electrode 28 is filled in the groove portion of the insulator 30 having an approximately U-shaped section, and is embedded so as for a portion thereof (bottom face) to be exposed on the surface of the upper plate main body 26.

It is preferable that the forming plates have an embodiment in which a taper portion whose plate thickness at a position in the taper portion becomes thinner as the position approaches upstream ends of the forming plates is formed in at least one of the pair of upper and lower forming plates, and a space between the pair of the forming plates at a position in the taper portion becomes larger, due to the taper portion, as the position approaches the upstream ends of the forming plates. When such an embodiment is made, the holdup of the gypsum slurry is prepared immediately before the starting position of forming, thereby making it possible to keep the holdup volume of the gypsum slurry always constant. Accordingly, the gypsum slurry is molded while keeping a state in which the air is trapped therein, making it possible to effectively prevent a situation where gypsum boards in which internal voids are formed are produced. Thereby, it is possible to solve the problems of gypsum boards, such as bulging and denting, lowering of the smoothness, and dropping out of nails and screws (fixing failure of boards) when the gypsum boards are fixed, attributable to the above-described internal voids.

For example, in the production apparatus 1 as illustrated in FIG. 1, the production apparatus 1A as illustrated in FIG. 2, the production apparatus 1B as illustrated in FIG. 3, and the production apparatus 1C as illustrated in FIG. 5, the embodiment is the one in which a taper portion whose plate thickness at a position in the taper portion becomes thinner as the position approaches the upstream end (edge on the upstream side of the plate) of the lower forming plate 8 is formed in the lower forming plate 8, and a space between the pair of the forming plates 6 at a position in the taper portion becomes larger, due to the taper portion, as the position approaches the upstream end. However, a taper portion whose plate thickness at a position in the taper portion becomes thinner as the position approaches upstream end of a forming plate may be formed in the upper forming plate, or the taper portions may be formed in both the lower forming plate and the upper forming plate (not shown in the figures).

In the production apparatus of the present invention, it is preferable that the embedded electrode is embedded at a portion on a downstream side of the starting position of forming in the plate main body, and it is further preferable that the embedded electrode is embedded, in the plate main body, at a portion within a range from the starting position of forming to a position on the downstream side of the starting position of forming by 50 mm. The space between plates at the starting position of forming is narrower than the space between plates on the upstream side of the starting position of forming for the purpose of forming a laminated material obtained by injecting a gypsum slurry into a gap between a pair of upper and lower lining paper sheets so as to form the thickness of the laminated material depending on the space between plates. Therefore, the starting position of forming is a region where foreign bodies are liable to be caught and where there is a high possibility that the cut of the lining paper sheet is liable to occur. Accordingly, in order to detect the cut of the lining paper sheet early, it can be said that it is preferable to arrange the embedded electrode at a position near the starting position of forming. Specifically, it is particularly preferable that the embedded electrode is embedded at a portion within a range from the starting position of forming to a position on the downstream side of the starting position of forming by 25 mm.

On the other hand, there is a time lag from the time when the lining paper sheet is cut to the time when the gypsum slurry begins to leak out. Accordingly, it is more preferable that the embedded electrode is embedded at a position somewhat downstream side of the starting position of forming in the plate main body than that the embedded electrode is embedded at the starting position of forming in the plate main body. Moreover, when the production speed of the gypsum board becomes high, the position where the leak out of the gypsum slurry can be detected after the lining paper sheet is cut recedes from the starting position of forming. Accordingly, in the case where high speed production is conducted, it is preferable that the embedding electrode is embedded at a portion on further downstream side in the plate main body than in the case where low speed production is conducted. Specifically, it is preferable that the embedded electrode is embedded, in the plate main body, at a portion on further downstream side of a position on the downstream side of the starting position of forming by 15 mm.

As described above, it is necessary that an appropriate embedding position of the embedded electrode be determined, in the plate main body, within a portion on the downstream side of the starting position of forming (particularly, a portion within a range from the starting position of forming to a position on the downstream side of the starting position of forming by 50 mm) considering the production speed.

In addition, the "starting position of forming" means a position where forming of the laminated material obtained by injecting a gypsum slurry into a gap between a pair of lining paper sheets is started, and specifically means a position on the most downstream side of the following (1) and the following (2). Hereinafter, explanation will be made on the starting position of forming with reference to FIG. 6A to FIG. 6E. In addition, the embedded electrode, the insulator, and so on are omitted, and only the shape of the forming plates are illustrated in FIG. 6A to FIG. 6E for the convenience of drawing. Moreover, the thick arrow in FIG. 6A to FIG. 6E shows a transportation direction (namely, downstream direction) of the laminated material.

(1) a position of an upstream end of either one of the pair of upper and lower forming plates; and (2) a position of a downstream end of a taper portion in an embodiment wherein the taper portion whose plate thickness at a position in the taper portion becomes thinner as the position approaches upstream ends of the forming plates is formed in at least one of the pair of upper and lower forming plates, and a space between the pair of the forming plates at a position in the taper portion becomes larger, due to the taper portion, as the position approaches the upstream ends of the forming plates.

The production apparatus of the present invention is a production apparatus for obtaining a molded body having a thickness depending on the space between plates by allowing the laminated material to pass between a pair of upper and lower forming plates. Accordingly, in forming the laminated body, a pair of upper and lower forming plates are arranged so as to face each other, and forming is started at a position where the space of the plates is sufficiently narrowed to such an extent that forming is possible. In the case of an embodiment where the taper portion is not formed on the upstream side of any of the pair of upper and lower forming plates (upper forming plate and lower forming plate), a position of the upstream end of any one of the pair of upper and lower forming plates becomes the starting position of forming.

In the example as illustrated in FIG. 6A for example, the position of the upstream end 24*a* of the upper forming plate 24 and the position of the upstream end 8*a* of the lower forming plate 8 are located on one straight line. That is to say, on the downstream side of the upstream ends 24*a* and 8*a*, a pair of upper and lower forming plates 6 are arranged so as to face each other, and the space between plates are sufficiently narrowed to such an extent that forming is possible. Accordingly, the position of the upstream end 24*a* of the upper forming plate 24 (or the position of the upstream end 8*a* of the lower forming plate 8) becomes the starting position of forming P.

Moreover, in the example as illustrated in FIG. 6B, the pair of upper and lower forming plates are arranged so that the upstream end 8*a* of the lower forming plate 8 protrudes on the upstream side of the upstream end 24*a* of the upper forming plate 24. In the case of such an embodiment, the pair of upper and lower forming plates 6 are arranged so as to face each other on the downstream side of the upstream end 24*a* of the upper forming plate 24, and the space between the plates is sufficiently narrowed to such an extent that forming is possible. Accordingly, the position of the upstream end 24*a* of the upper forming plate 24 becomes the starting position of forming P.

In the case of an embodiment in which a taper portion whose plate thickness at a position in the taper portion becomes thinner as the position approaches upstream ends of the forming plates is formed in at least one of the pair of upper and lower forming plates, and a space between the pair of the forming plates at a position in the taper portion becomes larger, due to the taper portion, as the position approaches the upstream ends of the forming plates, the position of the downstream end of the taper portion can also become the starting position of forming in addition to the position of the upstream ends of the pair of upper and lower forming plates. Here, "the space between the pair of upper and lower forming plates at a position in the taper portion becomes larger, due to the taper portion, as the position approaches the upstream end" means, in other words, that the slope face of the taper portion is formed on the side of a face that makes contact with the lining paper sheet in the forming plate.

In the example as illustrated in FIG. 6C for example, the position of the upstream end 24*a* of the upper forming plate 24 and the position of the upstream end 8*a* of the lower forming plate 8 are located on one straight line. That is to say, a pair of upper and lower forming plates 6 are arranged so as to face each other on the downstream side of the upstream ends 24*a* and 8*a*. However, the space between the pair of upper and lower forming plates 6 becomes larger at the position of the upstream end 8*a* of the lower forming plate 8 due to the taper portion 8*b*, and the space is not sufficiently narrowed to such an extent that forming is possible. Accordingly, the position of the downstream end 8*c* of the taper portion 8*b* where space between the pair of upper and lower forming plates 6 is sufficiently narrowed becomes the starting position of forming P.

Moreover, also in the example as illustrated in FIG. 6D, the position of the upstream end 24*a* of the upper forming plate 24 and the position of the upstream end 8*a* of the lower forming plate 8 are located on one straight line, and a pair of upper and lower forming plates 6 are arranged so as to face each other on the downstream side of the upstream ends 24*a* and 8*a*. However, the space between the pair of upper and lower forming plates 6 becomes larger at the position of the upstream end 24*a* of the upper forming plate 24 due to the taper portion 24*b*, and the space is not sufficiently narrowed to such an extent that forming is possible. Accordingly, the position of the downstream end 24*c* of the taper portion 24*b* where space between the pair of upper and lower forming plates 6 is sufficiently narrowed becomes the starting position of forming P.

Further in the example as shown in FIG. 6E, it can be said that the upper and lower forming plates are arranged so that the upstream end 8*a* of the lower forming plate 8 protrudes on the upstream side of the upstream end 24*a* of the upper forming plate 24 and a pair of upper and lower forming plates 6 are arranged so as to face each other on the downstream side of the upstream end 24*a* of the upper forming plate 24. However, the space between the pair of forming plates 6 becomes larger due to the taper portion 24*b* of the upper forming plate 24 and the taper portion 8*b* of the lower forming plate 8 at the position of the upstream end 24*a* of the upper forming plate 24, and the space is not sufficiently narrowed to such an extent that forming is possible. Accordingly, the position of the downstream end 24*c* of the taper portion 24*b* where the space between the pair of upper and lower forming plates 6 is sufficiently narrowed becomes the starting point of forming P.

[2-2] Circuit:

In the apparatus for producing a gypsum board of the present invention, a circuit is constituted by electrically connecting the embedded electrode and the plate main body in which the embedded electrode is embedded.

For example, the production apparatus 1 as illustrated in FIG. 1 is an example in which the circuit 18 is constituted by electrically connecting the lower embedded electrode 12, the lower plate main body 10, and the pour source D1. On the other hand, the production apparatus 1A as illustrated in FIG. 2 is an example in which the circuit 34 is constituted by electrically connecting the upper embedded electrode 28 and the upper plate main body 26. Further, as in the production apparatus 1B as illustrated in FIG. 3, the circuit 34 may be constituted by electrically connecting the upper embedded electrode 28 and the upper plate main body 26 in addition to the circuit 18 constituted by electrically connecting the lower embedded electrode 12 and the lower plate main body 10.

Furthermore, as illustrated in FIG. 5, the circuit 40 including the lower external electrode 38, the lower plate main body 10, and the power source D3 may be constituted in addition to the circuit 18. In addition, the circuit 40 including the lower external electrode 38 may be formed together with the circuit 34 including the upper embedded electrode 28 as illustrated in FIG. 2 (not shown in the figure). Moreover, the circuit 40 may be formed together with the circuit 18 including the lower embedded electrode 12 as illustrated in FIG. 3 and the circuit 34 including the upper embedded electrode 28 (not shown in the figure).

[2-3] Electric Current Detector:

The apparatus for producing a gypsum board of the present invention includes an electric current detector electrically connected to the circuit that connects the embedded electrode and the plate main body. With the electric current detector, the cut of the lining paper sheet, or the like can be detected.

For example, the production apparatus 1 as illustrated in FIG. 1 includes an electric current detector 20 that is electrically connected to the circuit 18, and makes it possible to detect a current that flows between the lower embedded electrode 12 and the lower plate main body 10. On the other hand, the production apparatus 1A as illustrated in FIG. 2 includes an electric current detector 20 that is electrically connected to the circuit 34, and makes it possible to detect a current that flows between the upper embedded electrode 28 and the upper plate main body 26. Further, the production apparatus 1B as illustrated in FIG. 3 includes an electric current detector 20 that is electrically connected to both the circuit 18 and the circuit 34. Thereby, it becomes possible to detect both the current that flows between the lower embedded electrode 12 and the lower plate main body 10 and the current that flows between the upper embedded electrode 28 and the upper plate main body 26. In the case where a plurality of circuits exist, a plurality of circuits 18 and 34 may share the electric current detector 20 as illustrated in FIG. 3.

[2-4] Actuator:

The apparatus for producing a gypsum board of the present invention includes an actuator that moves at least one of forming plates up and down in response to an electric signal from the electric current detector.

For example, the production apparatus 1 as illustrated in FIG. 1, the production apparatus 1A as illustrated in FIG. 2, the production apparatus 1B as illustrated in FIG. 3, and the production apparatus 1C as illustrated in FIG. 5 include an actuator 22 that moves the upper forming plate 24 up and down in response to an electric signal from the electric current detector 20. However, the production apparatus of the present invention may be a production apparatus including an actuator that moves the lower forming plate up and down, or may be a production apparatus including an actuator that moves both the upper forming plate and the lower forming plate up and down (not shown in the figure).

The actuator may be a device that drives the forming plate up and down depending on the electric current detector. Specific examples of the kind of the device include, but not particularly limited to, an air cylinder, an oil cylinder, a servomotor, and so on.

EXAMPLES

Hereinafter, the present invention will be explained in more specifically by Examples and Comparative Examples. However, the present invention is not limited to only the constitution of the following Examples.

Example 1

As a production apparatus of Example 1, the production apparatus 1 as illustrated in FIG. 1 was manufactured. A gypsum board to be produced was determined to be a gypsum board having a width of 910 mm and a thickness of 9.5 mm. In the production apparatus 1, the lining paper sheet 2 (upper lining paper sheet 32 and lower lining paper sheet 16) is transferred from the right-hand side to the left-hand side in the figure. The production apparatus is constituted so that the gypsum slurry 4 is continuously supplied on the lower lining paper sheet 16. The roll 36 is a roll for changing the supplying direction of the upper lining paper sheet 32.

[1-1] Forming Plates:

The production apparatus including a pair of upper and lower forming plates 6 (the lower forming plate 8 and upper forming plate 24) was used. The lower forming plate 8 having: the lower plate main body 10; and the lower embedded electrode embedded in the lower plate main body 10 was used. The upper plate main body 26 and the lower plate main body 10 were constituted from a material obtained by applying hard chromium plating on an iron material. The lower embedded electrode 12 was made of a stainless material, and had a square section of 6 mm×6 mm and a square rod-like shape having a length of 1200 mm.

The lower embedded electrode 12 and the lower plate main body 10 were electrically insulated by the insulator 14. The insulator 14 was constituted from a phenol resin laminated plate with a cloth base material. The insulator had an approximately U-shaped section and an approximately square rod-like shape in which a groove portion was formed. The lower embedded electrode 12 was filled in the groove portion of the insulator 14 and was embedded so that a portion thereof (upper face) was exposed on the surface of the lower plate main body 10. The insulator 14 was arranged on the front and behind sides of the lower embedded electrode 12 with a width of 5 mm to electrically insulate the lower embedded electrode 12. The lower embedded electrode 12 was embedded at a portion ranging from a position on the downstream side of the starting position of forming by 15 mm to a position on the downstream side of the starting position of forming by 21 mm in the lower plate main body 10. That is to say, the lower embedded electrode 12 was exposed on the surface of the lower plate main body 10 over a width of 6 mm.

The taper portion was formed on the upstream end side of the lower forming plate 8. The length of the taper portion was determined to be 50 mm, and the height of the taper portion was determined to be 4 mm. On the downstream side of the taper portion, the lower forming plate 8 and the upper forming plate 24 are arranged so as to face each other, and the forming space is formed so that the space between plates is sufficiently narrowed to such an extent that forming is possible. The forming space is formed from the starting position of forming to a position on the downstream side of the starting position of forming by 300 mm.

[1-2] Circuit:

The lower embedded electrode 12, the lower plate main body 10, and the power source D1 were electrically connected to constitute the circuit 18.

[1-3] Electric Current Detector:

The electric current detector 20 was electrically connected to the circuit 18.

[1-4] Actuator:

The actuator 22 moving the upper forming plate 24 up and down in response to an electric signal from the electric current detector 20 was installed. An air cylinder was used as the actuator.

[1-5] Production of Gypsum Boards:

Gypsum boards were produced using the above-described production apparatus. The production speed of the gypsum board was determined to be 150 m/min. The production apparatus was operated for 20 days under the condition of continuously operating the production apparatus for 24 hours per day to find that the number of the cases where the lining paper sheet was completely torn to stop continuous production was only one.

Example 2

As a production apparatus of Example 2, the production apparatus 1A as illustrated in FIG. 2 was manufactured. The production apparatus was manufactured in the same manner as in the production apparatus of Example 1 except the matters described below.

[2-1] Forming Plates:

The production apparatus including a pair of upper and lower forming plates 6 (lower forming plate 8 and upper forming plate 24) was used. The upper plate main body 26 and the lower plate main body 10 were constituted from a material obtained by applying hard chromium plating on an iron material. The lower embedded electrode was not arranged in the lower forming plate 8, and the upper embedded electrode 28 was arranged in the upper forming plate 24. The upper embedded electrode 28 was made of a stainless material, and had a square section of 6 mm×6 mm and a square rod-like shape having a length of 1200 mm.

The upper embedded electrode 28 and the upper plate main body 26 were electrically insulated by the insulator 30. The insulator 30 was constituted from a phenol resin laminated plate with a cloth base material. The insulator had an approximately U-shaped section and an approximately square rod-like shape in which a groove portion was formed. The upper embedded electrode 28 was filled in the groove portion of the insulator 30, and was embedded so that a portion (bottom face) thereof was exposed on the surface of the upper plate main body 26. The insulator 30 was arranged on the front and behind sides of the upper embedded electrode 28 with a width of 5 mm to electrically insulate the upper embedded electrode 28. The upper embedded electrode 28 was embedded at a portion ranging from a position on the downstream side of the forming by 15 mm to a position on the downstream side of the starting position of forming by 21 mm in the upper plate main body 26. That is to say, the upper embedded electrode 28 was exposed on the surface of the upper plate main body 26 over a width of 6 mm.

[2-2] Circuit:

The upper embedded electrode 28, the upper plate main body 26, and the power source D2 were electrically connected to constitute the circuit 34.

[2-3] Electric Current Detector:

The electric current detector 20 was connected to the circuit 34.

[2-4] Production of Gypsum Boards:

Gypsum boards were produced using the above-described production apparatus. The production speed of the gypsum board was determined to be 150 m/min. The production apparatus was operated for 20 days under the condition of continuously operating the production apparatus for 24 hours per day to find that the number of the cases where the lining paper sheet was completely torn to stop continuous production was only two.

Example 3

As a production apparatus of Example 3, the production apparatus 1B as illustrated in FIG. 3 was manufactured. The production apparatus was manufactured in the same manner as in the production apparatus of Example 1 except the matters described below.

[3-1] Forming Plates:

The lower forming plate 8 was constituted in the same manner as in the production apparatus of Example 1. The lower embedded electrode 12 was embedded at a portion ranging from a position on the downstream side of the starting position of forming by 15 mm to a position on the downstream side of the starting position of forming by 21 mm in the lower plate main body 10. The upper forming plate 24 was constituted in the same manner as in the production apparatus of Example 2.

[3-2] Circuit:

The lower embedded electrode 12, the lower plate main body 10, and the power source D1 were electrically connected to constitute the circuit 18, and the upper embedded electrode 28, the upper plate main body 26, and the power source D2 were electrically connected to constitute the circuit 34.

[3-3] Electric Current Detector:

The electric current detector 20 was electrically connected to the circuit 18 and the circuit 34.

[3-4] Production of Gypsum Boards:

Gypsum boards were produced using the above-described production apparatus. The production speed of the gypsum board was determined to be 150 m/min. The production apparatus was operated for 20 days under the condition of continuously operating the production apparatus for 24 hours per day to find that the number of the cases where the lining paper sheet was completely torn to stop continuous production was only one.

Example 4

As a production apparatus of Example 4, the production apparatus 1B as illustrated in FIG. 3 was manufactured. The production apparatus was manufactured in the same manner as in the production apparatus of Example 1 except the matters described below.

[4-1] Forming Plates:

The lower forming plate 8 was constituted in the same manner as in the production apparatus of Example 1 except the position of the lower embedded electrode 12. The lower embedded electrode 12 was embedded at a portion ranging from a position on the downstream side of the starting position of forming by 25 mm to a position on the downstream side of the starting position of forming by 31 mm in the lower main plate main body 10. The upper forming plate 24 was constituted in the same manner as in the production apparatus of Example 2.

[4-2] Circuit:

The lower embedded electrode 12, the lower plate main body 10, and the power source D1 were electrically connected to constitute the circuit 18, and the upper embedded electrode 28, the upper plate main body 26, and the power source D2 were electrically connected to constitute the circuit 34.

[4-3] Electric Current Detector:

The electric current detector 20 was electrically connected to the circuit 18 and the circuit 24.

[4-4] Production of Gypsum Boards:

Gypsum boards were produced using the above-described production apparatus. The production speed of the gypsum board was determined to be 150 m/min. The production apparatus was operated for 20 days under the condition of continuously operating the production apparatus for 24 hours per day to find that there were no cases where the lining paper sheet was completely torn and there were also no cases where the continuous production was stopped.

Comparative Example 1

As a production apparatus of Comparative Example 1, the production apparatus 100 as illustrated in FIG. 4 was manufactured. The production apparatus was manufactured in the same manner as in the production apparatus of Example 1 except the matters described below.

[5-1] Forming Plates:

The lower embedded electrode was not arranged in the lower forming plate 108. Instead, the lower external electrode 138 was arranged at a position apart from the end (downstream end) of the lower forming plate 108 by 10 mm on the downstream side. The lower external electrode 138 was arranged in a state where the lower external electrode was electrically isolated from the surroundings. The lower external electrode 138 was made of an iron material obtained by applying hard chromium plating thereon, and had a square section of 24 mm×24 mm and a square rod-like shape having a length of 1200 mm. The upper forming plate 124 was constituted in the same manner as in the upper forming plate 24 of the production apparatus of Example 1.

[5-2] Circuit:

The lower external electrode 138, the lower forming plate 108, and the power source D3 were electrically connected to constitute the circuit 140.

[5-3] Electric Current Detector:

The electric current detector 120 was electrically connected to the circuit 140.

[5-4] Production of Gypsum Boards:

Gypsum boards were produced using the above-described production apparatus. The production speed of the gypsum board was determined to be 150 m/min. The production apparatus was operated for 20 days under the condition of continuously operating the production apparatus for 24 hours per day to find that the number of the cases where the lining paper sheet was completely torn to stop continuous production reached 10.

INDUSTRIAL APPLICABILITY

The method and apparatus for producing a gypsum board of the present invention can suitably be used for producing gypsum boards useful as building materials such as ceiling materials, wall materials, flooring materials.

REFERENCE SIGNS LIST

1A, 1B and 1C (Gypsum board) Production apparatus
2 Lining paper sheet
4 Gypsum slurry
6 Forming plate
8 Lower forming plate
8*a* Upstream end
8*b* Taper portion
8*c* Downstream end
10 Lower plate main body
12 Lower embedded electrode
14 Insulator
16 Lower lining paper sheet
18 Circuit
20 Electric current detector
22 Actuator
24 Upper forming plate
24*a* Upstream end
24*b* Taper portion
24*c* Downstream end
26 Upper plate main body
28 Upper embedded electrode
30 Insulator
32 Upper lining paper sheet
34 Circuit
36 Roll
38 Lower external electrode
40 Circuit
100 (Gypsum board) Production Apparatus
104 Gypsum slurry
108 Lower forming plate
116 Lower lining paper sheet
120 Electric current detector
122 Air cylinder
124 Upper forming plate
132 Upper lining paper sheet
136 Roll
138 Lower external electrode
140 Circuit
C Ground
D, D1, D2, and D3 Power source
P Starting position of forming

The invention claimed is:

1. A method for producing a gypsum board, the method comprising:

continuously injecting a gypsum slurry into a gap between a pair of upper and lower lining paper sheets while continuously supplying the pair of upper and lower lining paper sheets, so as to form a laminated material; and allowing the laminated material to pass between a pair of upper and lower forming plates so as to form a molded body having a thickness corresponding to a space between the upper and lower forming plates, wherein at least one of the upper and lower forming plates comprises:

a plate main body comprising an electrically conductive material; and an embedded electrode embedded in the plate main body, wherein the embedded electrode is electrically insulated from the plate main body by an insulator and is embedded so that a portion of the embedded electrode is exposed on a surface of the plate main body, where the plate main body contacts the lining paper sheet, a circuit is completed by electrically connecting the plate main body and the embedded electrode embedded in the plate main body, and a voltage is applied to the circuit, and whenever the lining paper sheet adjacent the embedded electrode is cut, the plate main body and the embedded electrode contact with the gypsum slurry, electric current flows in the circuit, and the space between the pair of upper and lower forming plates is expanded until the electric current flows are broken, and thereafter the space between the pair of upper and lower forming plates is restored to the original space.

2. The method for producing a gypsum board according to claim 1, wherein the embedded electrode is embedded in the plate main body at a portion on a downstream side relative to a starting position of forming the gypsum board, where the starting position of forming the gypsum board is defined as one of the following (1) and the following (2), whichever is located at a more downstream side:

(1) a position of an upstream end of either one of the pair of upper and lower forming plates; and (2) a position of a downstream end of a taper portion if present in an embodiment, wherein the taper portion is formed on at least one of the pair of upper and lower forming plates, a plate thickness of the taper portion becomes thinner toward the upstream ends of the forming plates, and the space between the pair of the forming plates becomes larger toward the upstream ends of the forming plates, corresponding to the plate thickness.

3. The method for producing a gypsum board according to claim 2, wherein the embedded electrode is embedded in the plate main body between the starting position of forming the gypsum board and a position of 50 mm to a downstream side from the starting position.

4. The method for producing a gypsum board according to claim 1, wherein the insulator comprises at least one material selected from the group consisting of phenol resin laminated plates with a cloth base material, phenol resin laminated plates with a paper base material, epoxy resin-impregnated glass fiber cloth, and epoxy resin-impregnated paper.

5. The method for producing a gypsum board according to claim 1, wherein the electrically conductive material is at least one material selected from the group consisting of iron materials, stainless steel materials, and aluminum materials, or a material obtained by applying hard chromium plating thereon.

6. An apparatus for producing a gypsum board, comprising:

a pair of upper and lower forming plates for forming a laminated material, wherein the laminated material is obtained by injecting a gypsum slurry into a gap between a pair of upper and lower lining paper sheets, and a thickness of the laminated material corresponds to a space between the plates, wherein at least one of the pair of upper and lower forming plates comprises:

a plate main body comprising an electrically conductive material; and an embedded electrode embedded in the plate main body, wherein the embedded electrode is electrically insulated from the plate main body by an insulator and is embedded so that a portion of the embedded electrode is exposed on a surface of the plate main body, where the plate main body contacts the lining paper sheet, a circuit is completed by electrically connecting the plate main body and the embedded electrode embedded in the plate main body, and the apparatus further comprises:

an electric current detector, which is electrically connected to the circuit; and an actuator, which moves at least one of the forming plates, up and down in response to an electric signal from the electric current detector.

7. The apparatus for producing a gypsum board according to claim 6, wherein the embedded electrode is embedded in the plate main body at a portion on a downstream side relative to a starting position of forming the gypsum board, where the starting position of forming the gypsum board is defined as one of the following (1) and the following (2), whichever is located at a more downstream side:

(1) a position of an upstream end of either one of the pair of upper and lower forming plates; and (2) a position of a downstream end of a taper portion if present in an embodiment, wherein the taper portion is formed on at least one of the pair of upper and lower forming plates, a plate thickness of the taper portion becomes thinner toward the upstream ends of the forming plates, and the space between the pair of the forming plates becomes larger the taper portion toward the upstream ends of the forming plates, corresponding to the plate thickness.

8. The apparatus for producing a gypsum board according to claim 7, wherein the embedded electrode is embedded, in the plate main body between the starting position of forming the gypsum board and a position of 50 mm to a downstream side from the starting position.

9. The apparatus for producing a gypsum board according to claim 6, wherein the insulator comprises at least one material selected from the group consisting of phenol resin laminated plates with a cloth base material, phenol resin laminated plates with a paper base material, epoxy resin-impregnated glass fiber cloth, and epoxy resin-impregnated paper.

10. The apparatus for producing a gypsum board according to claim 6, wherein the electrically conductive material is at least one material selected from the group consisting of iron materials, stainless steel materials, and aluminum materials, or a material obtained by applying hard chromium plating thereon.

* * * * *